United States Patent [19]

Field

[11] Patent Number: 4,588,093

[45] Date of Patent: May 13, 1986

[54] MERCHANDISE DISPLAY DEVICE

[76] Inventor: Frank P. Field, 122 Eucalyptus Dr., El Segundo, Calif. 90245

[21] Appl. No.: 697,701

[22] Filed: Feb. 4, 1985

Related U.S. Application Data

[63] Continuation of Ser. No. 451,004, Dec. 20, 1982.

[51] Int. Cl.[4] ..... A47F 5/00

[52] U.S. Cl. ..... 211/51; 211/11; 211/59.3; 267/165

[58] Field of Search ..... 211/51, 49 D, 43, 11; 312/61; 221/279, 56, 58, 59; 267/165; 206/45.16, 126, 255, 559

[56] References Cited

U.S. PATENT DOCUMENTS

| | | | |
|---|---|---|---|
| 1,682,580 | 8/1928 | Pratt . | |
| 1,893,098 | 1/1933 | Murray et al. | 267/165 X |
| 1,959,614 | 5/1934 | Coons . | |
| 2,124,780 | 7/1938 | Keppler et al. | 211/51 |
| 2,222,887 | 11/1940 | Willey . | |
| 2,331,035 | 10/1943 | Lundstrom | 211/490 X |
| 2,435,104 | 1/1948 | Solomon | 312/61 |
| 2,538,165 | 1/1951 | Randtke | 211/51 X |
| 2,656,233 | 10/1953 | Bollmann | 312/61 |
| 2,732,952 | 1/1956 | Skelton | 211/49 |
| 2,855,632 | 10/1958 | Croce et al. | 267/165 X |
| 3,039,221 | 6/1962 | Musgrave | 267/165 X |
| 3,357,597 | 12/1967 | Groff . | |
| 3,393,948 | 7/1968 | Brefka | 312/61 |
| 3,679,096 | 7/1972 | Musser | 221/56 |
| 4,234,101 | 11/1980 | Pastore | 221/241 |

*Primary Examiner*—Robert W. Gibson, Jr.

*Attorney, Agent, or Firm*—Hubbard, Stetina & Brunda

[57] ABSTRACT

A merchandise display device adapted to maintain merchandise in an organized orientation upon a display surface is diclosed. The device comprises an insert sized to be positioned within a display case or drawer and includes a base plate formed to contact the merchandise, an anchor member adapted to attach the insert to the display case and an accordian-like extensible member positioned between the base plate and anchor member. The extensible member is provided with plural spring clips at each of its apexes to continuously bias the base plate away from the anchor member. As merchandise is removed from the display case, the device constantly urges the merchandise in a forward direction and thereby maintains the stack of merchandise in an organized orientation.

3 Claims, 5 Drawing Figures

MERCHANDISE DISPLAY DEVICE

This application is a continuation of application Ser. No. 451,004, filed Dec. 20, 1982.

BACKGROUND OF THE PRESENT INVENTION

The present invention relates to merchandise display devices and, more particularly, to a merchandise display insert adapted to be positioned within a display case or drawer and maintain the organization of display merchandise.

As is well known, a variety of consumer goods are merchandised in display cases which typically comprise a drawer or shelf wherein the display merchandise is stacked in parallel rows within the drawer. As merchandise is selectively removed from the drawer, the stacks of merchandise often collapse rendering the merchandise unsightly for display purposes.

Heretofore, it was typical practice to require sales personnel to continuously monitor and housekeep the display cases to insure that the merchandise remained in an organized fashion. As will be recognized, such monitoring and housekeeping by sales personnel detracts from other more profitable sales duties and thereby increases the overall cost of the merchandise.

SUMMARY OF THE PRESENT INVENTION

The present invention specifically addresses and alleviates the above-referenced deficiency associated in the art by providing a merchandise display device which is adapted to continuously maintain the organized orientation of merchandise positioned upon a display surface. More particularly, the present invention comprises an insert sized to be positioned within a display case or drawer. One end of the insert is provided with a generally L-shaped base plate sized to permit a portion of the merchandise to be stacked thereon, while the opposite end includes an anchor member adapted to be attached to the rear wall or bottom edge of the drawer shelf.

The anchor member and base plate are interconnected by an accordian-like extensible member which includes plural spring steel biasing chips positioned at each of its apexes. The spring clips cause a biasing force to be applied to the extensible member to continuously urge the base plate toward the front wall of the display drawer. Thus, as merchandise is selectively removed from the area of the drawer in front of the base plate, the extensible member constantly pushes the base plate 12 and remaining merchandise in a forward direction away from the anchor member and thereby maintains the stack of merchandise in an organized manner.

In the preferred embodiment, the merchandise display device of the present invention is integrally formed of a molded plastic material and includes a pair of spring stops or shoulders formed at each of the apexes of the extensible member. The inclusion of the spring stops permit the rapid mounting of the spring clips within the device in a single manual motion and maintains the same therein without the use of auxiliary retaining means. As such, the merchandise display device of the present invention is well suited for mass production, rapid assembly fabrication techniques which renders the resultant device cost effective.

In a first embodiment of the invention, the anchor member is formed to be attached to the rear wall of the display drawer, however, two alternative embodiments of the anchor member permit the same to be attached to the rear edge of a display surface or merely contact the rear wall of the display shelf.

DESCRIPTION OF THE DRAWINGS

These as well as other features of the present invention will become more apparent upon reference to the drawings, wherein.

DETAILED DESCRIPTION OF THE PREFERRED EMBODIMENT

Figure 1:
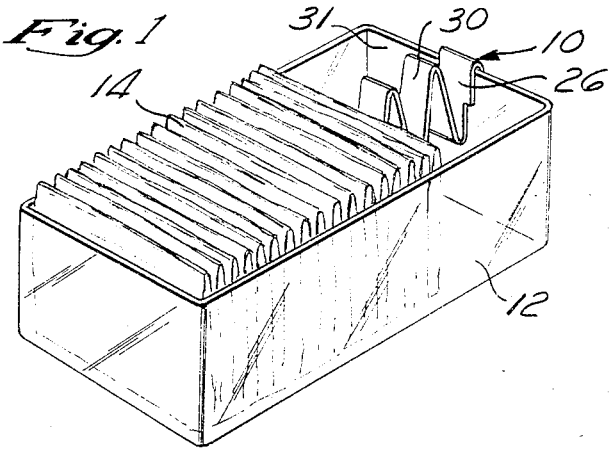
FIG. 1 is a perspective view of a display case drawer having display merchandise and the merchandise display device of the present invention disposed therein.
Figure 2:
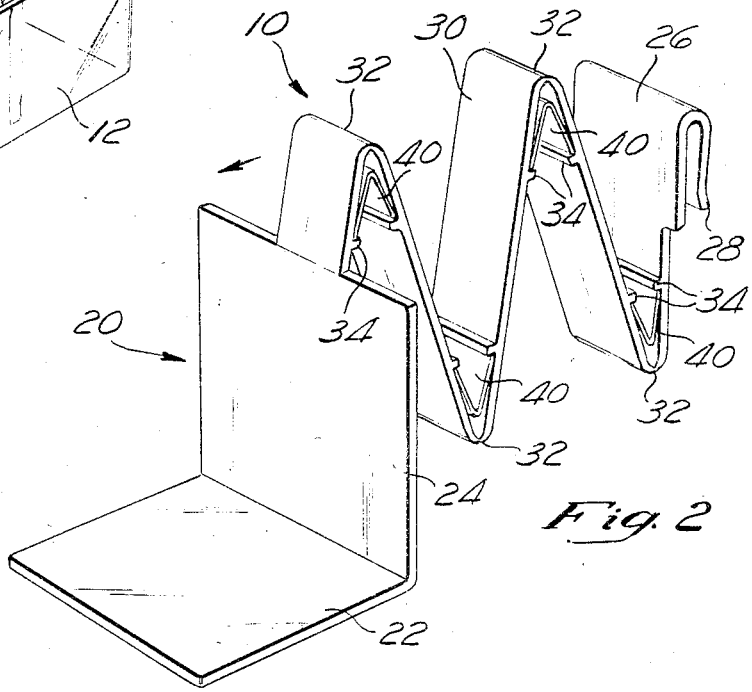
FIG. 2 is an enlarged perspective view of the merchandise display device of the present invention.

Referring generally to FIGS. 1 and 2, there is shown the merchandise display device or insert 10 of the present invention which may be placed within a display case or drawer 12 to maintain the stacked orientation of merchandise 14 positioned within the drawer 12. Merely by way of example and not limitation, the particular merchandise 14 depicted within the drawer 12 comprises a plurality of hosiery packages; however, those skilled in the art will recognize that various other merchandise may be utilized with the present invention.

As best shown in FIG. 2, the display device 10 of the present invention is formed having a generally L-shaped base plate 20 having a horizontal leg portion 22 adapted to reside beneath a portion of the merchandise 14 and a vertical leg portion 24 adapted to provide a rigid wall for abutment with one end of the merchandise stack. The opposite end of the device 10 is provided with an anchor member 26 which in its embodiment as depicted in FIG. 2, is formed to extend in a generally vertical direction and includes a bent over flange or clip 28. As shown in FIG. 1, the bent over flange 28 is sized to extend over the edge 30 of the rear wall of the display drawer 12 so as to detachably mount the device 10 within the drawer 12.

An extensible member 30 extends between the base plate 20 and anchor member 26 and is preferably formed in an accordian-like configuration composed of angularly extending interconnected elongate segments. At each of the apexes 32, the member 30 is provided with a reduced cross-sectional dimension so as to form a hinge which permits the member 30 to be extended or compressed laterally between the base plate 20 and anchor member 26. In the preferred embodiment, the entire insert 10 is formed of an integrally molded plastic material which is condusive to low-cost mass production fabricating techniques.

Figure 3:
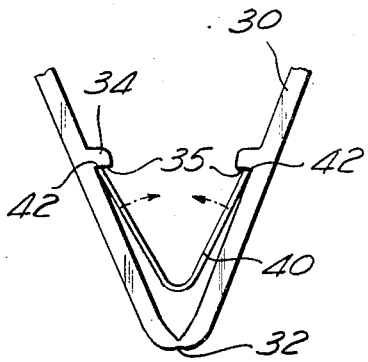
FIG. 3 is an enlarged elevational view showing the manner in which the spring clips are inserted and retained within the extensible member of the present invention.

Referring more particularly to FIG. 3, a pair of stops or protrusions 34 are formed on the extensible member 30 adjacent each of the apexes 32 which are designed to maintain plural generally V-shaped spring clips 40 therein. In the preferred embodiment, the spring clips 40 are formed of a thin spring steel material and are adapted to constantly urge the member 30 into a laterally extended position. As will be noted, from referring to FIG. 3, the plural stops 34 are spaced from the apexes 32 of the member 30 through a distance slightly greater than the overall length of the spring clips 40 such that the spring clips 40 may be manually inserted into the member 30 merely by pressing the spring clips 40 downward toward the apexes 32.

During this downward insertion movement of the spring clips 40, the distal ends of the spring clips 40 cam against the stops 34 causing the spring clips 40 to slightly compress inwardly as indicated by the phantom arrows in FIG. 3. Once the distal ends of the spring clips 40 pass downward beyond the edges 35 of the stops 34, the distal ends 42 spring outward and are thereby captured by the stops 34. Further, in view of the spring clips 40 being constantly urged outward and against the stops 34, it will be recognized that the spring clips 40 are permanently maintained against the stops 34 without any auxiliary mounting means and, thereby, continuously bias the member 30 in an extended orientation.

With the structure defined, the operation of the merchandise display insert 10 of the present invention may be described by referring to FIG. 1. Initially, the device 10 is positioned within the drawer 12 with the anchor member 26 being extended over the rear edge 30 of the drawer 12. A user (not shown) must then manually press the base plate 20 toward the anchor 26 to overcome the biasing force of the spring clips 40 and cause the member 30 to be compressed laterally.

The merchandise 14 may then be inserted into the drawer 12 in a side by side orientation. Preferably some of the merchandise 14 is positioned upon the horizontal leg portion 22 of the base plate 20 to thereby cause a weight force to be exerted upon the base plate 20 and insure that the horizontal leg portion 22 is continuously biased against the floor of the drawer 12. Subsequently, the user may release the base plate 20 wherein the extensible member 30 automatically extends laterally outward under the biasing force of the spring clips 40 to cause the vertical leg portion 24 of the base plate 20 to contact the merchandise 14 and slightly compress the merchandise 14 within the drawer 12.

As will be recognized, due to the extensible member 30 being continuously biased by the multiple spring clips 40 in an outward direction (as indicated by the arrow in FIG. 2) as merchandise 14 is removed from the drawer 12, the remaining merchandise is compressed within the drawer and maintained in its stacked organized configuration. By selecting the spring force of the spring clips within suitable tolerances, the compression force exerted by the device 10 may be maintained within suitable limits to allow easy removal and restocking of the merchandise 14 yet be sufficient to cause a moderate compression of the merchandise 14 within the drawer.

Figure 4:
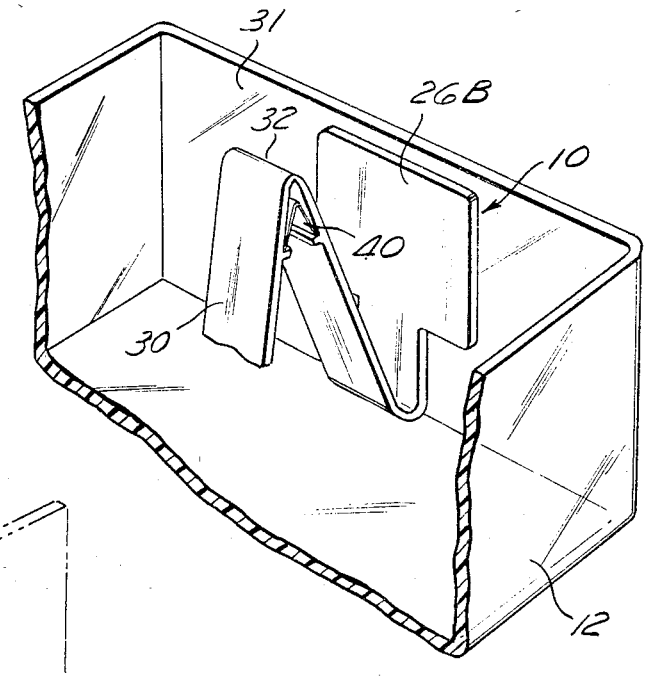
FIG. 4 is a partial perspective view showing the second embodiment of the anchor of the present invention.
Figure 5:
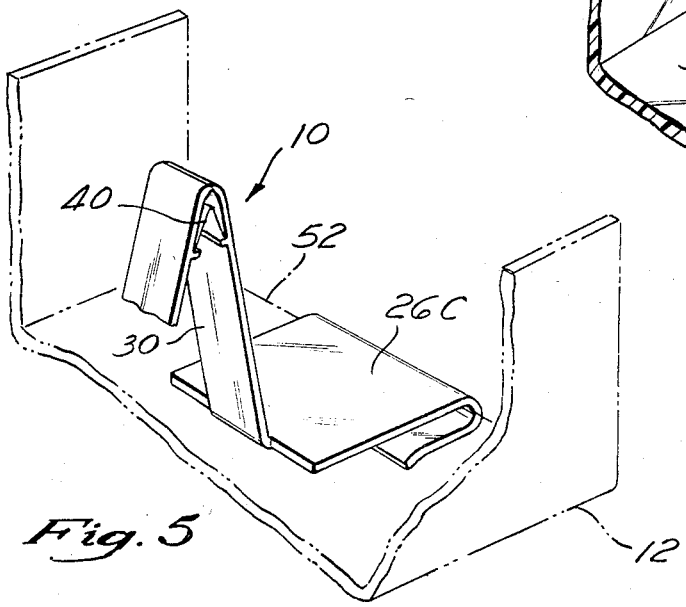
FIG. 5 is a partial perspective view of the third embodiment of the anchor member of the present invention.

In FIGS. 4 and 5, two additional embodiments of the anchor member 26 of the present invention are depicted. As shown in FIG. 4, the anchor member 26B is formed as a flat plate which is adapted to abutt the rear wall 31 of the display shelf 12. As will be recognized, due to the spring clips 40 mounted on the extensible member 30 constantly biasing the anchor member 26B away from the base plate 20, the anchor member 26 is continuously maintained tightly against the wall 31 of the drawer 12.

In FIG. 5, an additional embodiment of the anchor member 26C is depicted which is formed in a manner analgous to the embodiment shown in FIG. 2 except that the anchor member 26C is formed to extend in a generally parallel orientation as viewed in FIG. 5 (i.e. in a plane substantially parallel to the plane of the horizontal leg portion 22 of the base plate 20). This additional embodiment of the base member 26C is specifically adapted to permit the device 10 to be attached to the lower support surface 52 of a display drawer or case 12 when the display case 12 does not include a rear wall panel.

Although in the preferred embodiment certain part configurations and materials have been defined, those skilled in the art will recognize that various modifications can be made to the same without departing from the spirit of the present invention and that such modifications are clearly contemplated herein.

What is claimed is:

1. A device for maintaining merchandise in a stacked orientation within a display case comprising:
   - a base member formed to contact one end of a stack of merchandise disposed within a display case;
   - an anchor member adapted to be attached to said display case, wherein said anchor member comprises a bent over V-shaped clip adapted to be attached to one wall of said display case;
   - an extensible member integrally formed with said base member and said anchor member to extend between said base member and said anchor member, said extensible member having a plurality of interconnected elongate segments disposed in a bellow-like relative orientation to define a plurality of apexes at opposite ends of each elongate segment;
   - a plurality of V-shaped springs mounted to said extensible member, at each said apex, for biasing said extensible member to tend to elongate said extensible member and urge said base member away from said anchor member in a continuously expansive manner to continuously compress said stack of merchandise within said display case as individual merchandise is periodically removed from said stack of merchandise; and
   - a pair of stops formed adjacent each of said apexes for mounting said V-shaped spring to said extensible member.

2. The device of claim 1, wherein said base member, anchor member and extensible member are integrally molded of a plastic material.

3. The device of claim 1, wherein each of said stops comprises an elongate projection transverse to the length of said extensible member forming a slot for engaging an end of the corresponding spring.

* * * * *